United States Patent [19]

Rademacher

[11] 3,979,879

[45] Sept. 14, 1976

[54] BAG SUPPLY APPARATUS

[75] Inventor: Robert E. Rademacher, Richmond, Va.

[73] Assignee: AMF Incorporated, White Plains, N.Y.

[22] Filed: Nov. 11, 1975

[21] Appl. No.: 630,854

[52] U.S. Cl. ..... 53/67; 53/189

[51] Int. Cl.[2] ..... B65B 57/06; B65B 43/58

[58] Field of Search ..... 53/189, 188, 190, 384, 53/385, 67

[56] References Cited

UNITED STATES PATENTS

| | | | |
|---|---|---|---|
| 3,440,801 | 4/1969 | Prince et al. | 53/189 |
| 3,715,857 | 2/1973 | Fronczak | 53/189 |

*Primary Examiner*—Travis S. McGehee
*Attorney, Agent, or Firm*—George W. Price; Martin Smolowitz

[57] ABSTRACT

A bag supply apparatus for use with an article packaging apparatus providing bags on demand along in a predefined product flow line. Two spaced apart supply magazines are employed as part of the bag supply apparatus, one magazine being disposed in the product flow line and the second magazine being out-board of the product flow line. Each magazine is of a three part construction having a central telescoping body with a pivoting tail end section and a lip portion opposite thereto.

A positioning cam assembly urges the first magazine to a level consistent with the product flow line and is also responsive to a sensing arm disposed adjacent to the first magazine, for sensing the presence of bags at a predisposed operating height, so that the magazine moves upwardly at an incremental rate consistent with the supply of bags remaining in said magazine.

8 Claims, 2 Drawing Figures

BAG SUPPLY APPARATUS

The present invention is directed to an apparatus employed in conjunction with a material packaging machine. More particularly, the present invention is directed to a structure used to advance and provide a supply of bags for material to be inserted therein during a packaging operation; as for an example, the packaging of an array of buns into a plastic bag.

It is well established that in the packaging of material which is being introduced onto a conveyor for placement and orientation towards bags for finally wrapping the baked goods, the need for a continuous supply of bags being fed into the work station in an uninterrupted fashion and without causing jam-ups and damaged baked goods, is most desirable. While this is not always possible, the present invention, by virtue of certain unique features, provides the bags in proximity to the working station and being in a manner suitable for the introduction of product to be packaged.

Bags for baked product are almost universally made with an extended lip for wicketing consisting of a single layer of film and exposing a second layer of film which constitutes the end of the bag to be opened for product insertion; the bags are generally made with folded back or gussetted bottoms to provide fullness at the bottom such that a neat square appearance is achieved when product is inserted. This folded back or gussetted bottom constitutes four layers of film where the bags are laying flat in an unopened position on the wicket. Longitudinal side seams of the bags are heat-fused having a thin bead of material with a thickness somewhat in excess of the combined thickness of the layers of film forming the longitudinal sides of the bags. It is thus evident that a wicketed stack of 500 to 750 bags per wicket would present a very uneven upper surface if the wicketed bags are placed on a flat supporting surface. It is further evident that as bags from such a stack are removed one at a time, the upper surface tends to become more even but also the elevation of any point on the remaining upper surface continually decreases as bags are removed. In baggers which push product into the inflated bag at the top of a wicketed stack, such as the type bagger described herein, the product must pass over the wicketed stack of bags as the bag is being loaded and delivered to closing means. Because of this requirement for the product to pass over the wicketed stack of bags, it is highly desirable that the upper surface of the unfilled stack of bags be held in a constant level horizontal plane.

The prior art is quite notorious in allowing the supply of bags to be worked upon to overhang without any suitable support. This is quite clearly shown in U.S. Pat. No. 3,492,780. There are other patents which have some form of bag support so as to minimize such bags from hanging over.

The apparatus employed by the prior art in positioning the supply of bags with respect to the work station or positioning the magazine in the reload position presented a number of problems in terms of ease of operation and precise position of the bags for trouble free repetitive use. The use of multiple supply magazines in a manner permitting engagement in the product flow line for selective and alternate use in respect of the packaging apparatus represents an important aspect to the entire operation, especially where it may be required to handle different sizes and different quantities of product to be packaged, where different types of products to be packaged where may necessitate particular bags to do the job.

The magazine according to the invention has associated therewith three different levels for the bag position and is so designed that regardless of the quantity of bags (capacity of 750), the top bag will always lie in a flat plane. An important advantage to this type of bag placement resides in the fact that the bagged product is caused to pass over a level plane as it is being advanced in tact to the next work station. Without this type of arrangement, the product to be bagged, such as buns, tended to push the bun ahead of it as it advanced, with the result that any up and down motion caused the buns to shingle, resulting in an undesirable package.

Prior approaches in dealing with this problem had a quantity of bags placed over a plate somewhat shorter than the bag length, permitting the ends of the bag to hang down with the result that a non-level plane existed which interferred with motion of the pusher arm, and total performance of the bagging operation. To obviate this condition, attempts have been made to, in some manner to cause the bag to move out of the path of pusher arm, however, due to the nature of the product being bagged, i.e., loose rolls, any speed change in the forward direction would tend to loosen the top trailing buns at the open end of the bag.

Accordingly, it is the main object of the present invention to overcome the defects of the prior art.

It is still another object of the present invention to provide a wicket support table which will accommodate bags of various overall lengths and widths and compensate for both uneven thicknesses of the bags, to maintain a horizontal plane for the upper surface and automatically incrementally elevate as bags are removed, so that the upper surface is also held in substantially constant elevation.

It is still another object of the present invention to provide a wicket and magazine structure enabling the positioning of magazines of adjustable size in a work position in a non-demanding, simple manner.

Still another object of the present invention is to provide a pair of magazines which can be alternately engaged for supplying bags to the packaging apparatus.

Still further objects and advantages of the present invention will be best understood with reference to the specification, claims and accompanying drawings.

Figure 1:
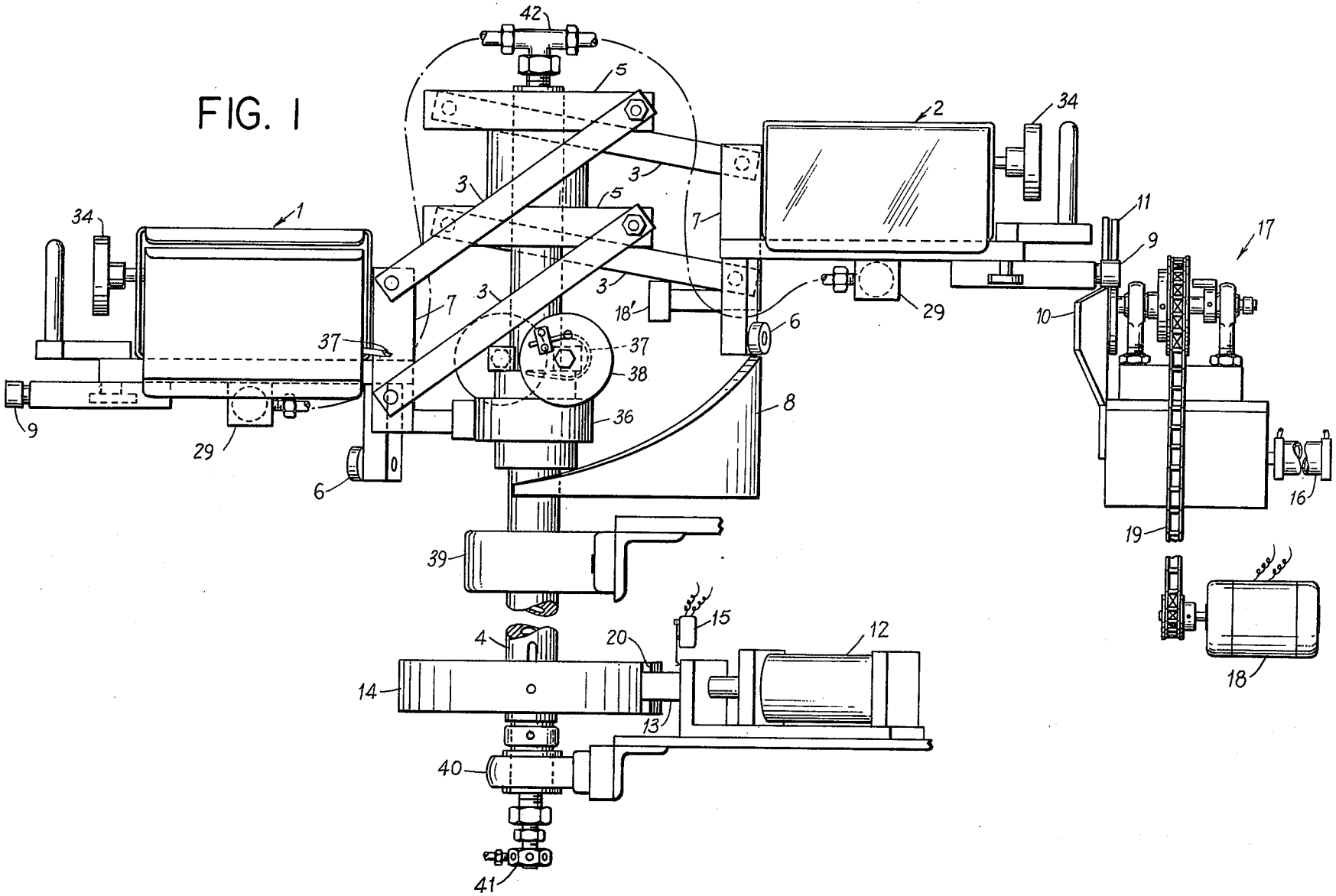
FIG. 1 is a side elevation of an assembly including the apparatus of the present invention.
Figure 2:
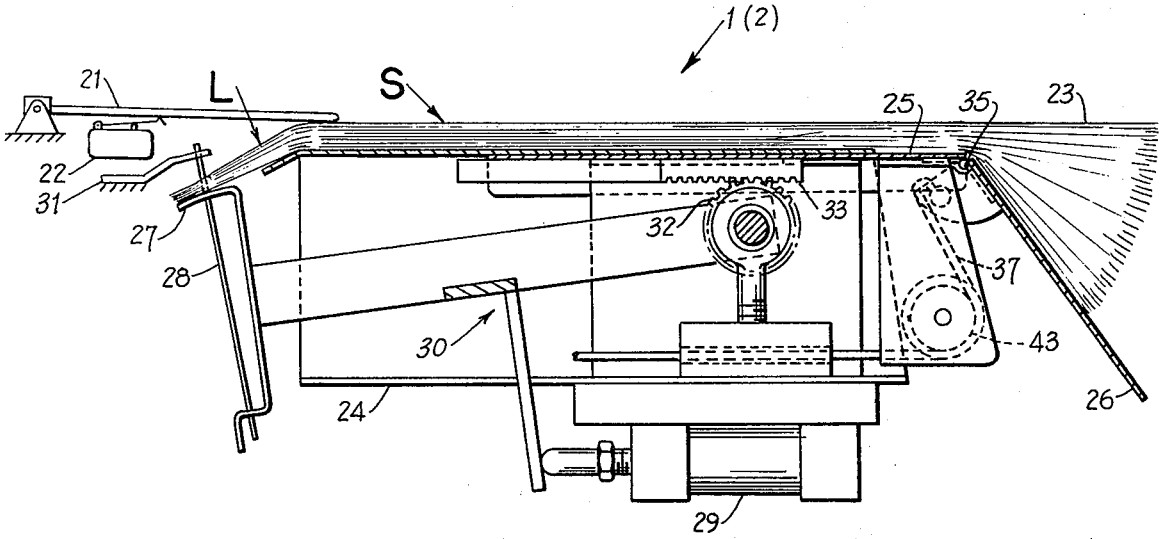
FIG. 2 is a partial sectional view of a magazine employed in the apparatus shown in FIG. 1.

According to FIG. 1, bag supply magazines 1, 2 are employed and are mounted on a common post 4, each magazine being adapted to rotate and pivot about post 4. The magazines 1, 2 are identical in size and shape, with a first magazine being designated as the working magazine 2 and a second magazine being designated as a reserve outboard magazine 1. At any given time, the working magazine 2 can be advanced and positioned at a bagging work station (not shown) which is part of any overall packaging machine assembly employing the present invention. As the working magazine 2 is emptied, the reserve or outboard magazine is reloaded by the operator and is ready for position into the work station through 180° of rotation, once the working magazine is emptied. This is achieved either manually or electrically by the cycle of the machine through shaft 4. Prior to rotating the reserve magazine 1, the working magazine 2 is released to drop below the working level of the apparatus by the action of a cylinder 16 which retracts the final elevation assembly 17 from a cam follower 9. The cylinder 16 is actuated by a signal, such as a manual signal transmitted through a foot pedal; or electrically by a control system of a conventional type which senses the absence of bag in the working magazine 2. Simultaneously, a motor 18 is actuated to rotate a final elevation cam 11 through a drive chain 19 to permit engagement of the cam follower 9 of reserve magazine 1 with cam 11 when the reserve magazine 1 rotates into working position prior to final elevation. A cylinder 12 is actuated by the operator, such as by a foot pedal, to withdraw the rod 13 from a locking notch of a rotation locating cam 14. This action permits the working magazine 2 to fall until arm 18' contacts bumper stop 19 through the action of linkage 3 directing the arm 18' in an arcuate path. At this juncture, the magazine 2 is free to rotate into the reserve position held by reserve magazine 1 simultaneously as each reserve magazine 1 rotates to the working position formally held by working magazine 2.

As a filled or partially filled reserve magazine 1 is rotated into the working position, it is cammed up to a work height while rotating about post 4. As previously mentioned, the two magazines 1, 2 are employed to function about shaft 4. These magazines are mounted on a parallel linkage 3 connected to a pivot block 5 through the shaft 4 which in turn is mounted to the bagging machine (not shown) through bearings 39, 40. As the magazines 1, 2 are rotated, the operator, by an appropriate signal, such as the release of a foot pedal, actuates cylinder 12 to move the rod 13 against rotation locating cam 14, the shaft 4 and the attached magazines 1, 2 are still free to rotate, since the locking notch 20 is rotated away from the rod 13. The cam 14 is provided with two notches 20 which are 180° apart from one another.

A cam arm roller 6 is attached to magazine frame 7 so as the reserve magazine 1 is rotated into the working position, the cam roller 6 engages a cam 8 causing the reserve magazine 1 to elevate. As the reserve magazine 1 approaches its working position, the cam follower 9 engages a stop cam 10 just prior to the attainment of the maximum position of cam 6 on cam 8, during this time, the reserve magazine 1 is continuing to elevate. When the cam follower arm 9 has reached its maximum travel on stop cam 10, the cylinder rod 13 mounted on the locking cylinder 12 engages notch 20 of the rotation locating cam 14 on shaft 4. At this point, the reserve magazine 1 is locked rotationally in its working position. Furthermore, the reserve magazine 1 is ready for final elevation to a working height.

Final elevation is accomplished by actuation of a motor 18 by an electrical signal imparted through the closing of switch 15 which senses the engagement of the rod 30 with notch 20. Motor 18 rotates cam 11 enabling engagement with cam follower arm 9 to cause the arm 9 to elevate from contact with cam 10 into final working height. The final working position of magazine 2 is determined by the quantity of bags in the magazine at any given instance. A pivotable sensing spring loaded arm 21 is mounted on the bagging machine frame (not shown) and extends over the working magazine 2. A sensing switch 22 is positioned to co-act with the arm 21 depending upon the level of the bags in the magazine 2. The sensing arm 21 will cause an electrical signal to be imparted through switch 22 when the top surface in magazine 2 has attained a predefined height with respect to the line of travel of product flow. Once the switch 22 is energized in the aforementioned manner, the motor 18 is caused to stop, causing magazine 2 to halt in its elevation. As bags are consumed, the arm 21 moves downwardly in relation to the number of bags used in the bagging operation. The switch 22 is sufficiently sensitive, such that for every increment of height change caused by bag consumption, there is a corresponding signal sent to the motor 18 causing the cam 11 to rotate and move magazine 2 in the upward direction to compensate for the loss of height due to bag consumption; with the result that constant bag level is attained within suitably small increments. The arm 21 is in electrical circuit relation with the magazine 2 such that when the last bag is used, it will close the circuit on the magazine 2 and stop the associated packaging operation until such bags 23 have been replenished. At the instant this occurs, the bagging operation will cease and will not receive any additional goods for packaging. Simultaneous with this occurrance, the cylinder 16 is actuated to withdraw assembly 17, disengaging it from the cam follower 9 and allowing the magazine 2 to drop below the working height as previously described.

The bag supply magazines 1, 2 consist of a base 24 having associated therewith one or more telescoping sections 25 for bag length adjustment, a tail section 26 and a lip section 27. These three particular sections 25, 26, 27 are disposed longitudinally to correspond with the three main sections of the bag; namely, the tail, body, and lip.

By the aforementioned magazine configuration, it is at all times possible to maintain the top surface of the bag S in a level plane regardless of the quantity of bags remaining in the magazines 1, 2. The magazine 2 is caused to be elevated into the working position, that is, into the line of travel of the materials being packaged, by means of a cam 11 and motor 18 which are controlled through a arm 21, such that the lip of the bag L is held in place by a elongated wire 28 (wicket wire) and the wire 28 and lip L of the bag are given a variable release pressure by the amount of pressure placed on the lip L of the bag by a cylinder 29 with the result that the breakaway resistance of the bag 23 is able to be controlled by means of pressure exerted at the lip L by control of the opposing forces generated by the air pressure of the cylinder 29. Cylinder 29 receives air from supply 41 through a distribution fitting 42 and acts on the magazine lip 27 through a linkage 30. The force transmitted provides sufficient pressure to the lip 27 causing it to pinch between the magazine lip 27 and a retaining plate 31 fixed to the bagging machine. This serves to retain the bag at the lip end while the product is being introduced with the result that there is a tightly fitting package. The telescoping sections 25 operate through a pinion 32 and a gear rack 33 whereby the operator can adjust, by manual means, through handle 34, the degree of telescoping in accordance with bag length.

As bags are being consumed, the tail section 26 of each of the magazines 1, 2 is urged to move in an upward direction so as to maintain the gussetted tail section of the bag in a level position with respect to the other portion of the bag 23. The tail section 26 is pivotally attached to the telescoping sections 25 at point 35 and moves in a predefined manner. A cable 37 acting through pulley 43 is attached to the tail section 26 at one end and to a mounting 38 on the shaft 4. The mounting 38 is at a constant level with respect to the line of product flow. By tension adjustment of cable 37, the tail section 26 (as bags are being consumed) is raised and magazine 2 elevates to maintain a constant bag level. The cable 37 is attached to the tail section 26 in tension and moves the tail section at a rate of travel in excess of that of magazine 2; however, its rate of travel is a function of the ratio between the bag body thickness and the gussetted tail thickness. For example, if the tail is two times as thick as the bag body, it follows that the tail will travel at twice the rate of speed of the magazine 2.

As a result of the present invention it becomes possible to place the buns into the bags by known means, such as articulated scoops, which are able to engage the buns in a manner that will permit them to be slightly compressed during their introduction into the bags, at which point they are not able to spring back to their ambient size until after the scoops are out of the bag. What follows, is that once the buns or other material to be packaged are in the bag they are very tightly and firmly nestled therein. This all being accomplished, without placing the buns in any type of external cardboard container or employing a backing sheet of still material.

It is to be understood that the inventive assembly can form a part of any overall packaging apparatus employing a well established conveying and product positioning apparatuses known to the art. When used in this manner, the invention is disposed downstream of the product flow in proximity to an assembly for introducing the buns or the like into the bags being dispensed by the apparatus of the present invention. At some point beyond the work station in which the present invention is employed, another conveying means receives the as packaged material for tying or sealing and movement to a storage area.

I claim:

1. A bag supply apparatus for providing a supply of bags to an article packaging apparatus, said bag supply apparatus being disposed in proximity to a bagging station of said packaging apparatus, providing individual bags on demand along in a predefined product flow line, including: individual spaced apart working and reserve supply magazines; said working magazine being disposed in the product flow line and said reserve magazine being outboard of said product flow line; each of said magazines being movable on advancing means, said advancing means being adapted to urge a depleted working magazine out of the product flow line and simultaneously urge a loaded reserve magazine into the product flow line; positioning means for positioning said working magazine to a level consistent with the product flow line, said positioning means being further defined by control means operable in response to sensing means disposed adjacent to said working magazine, for sensing the presence of bags in said working magazine at a predisposed operating height with respect to said product flow line as said working magazine moves upwardly at an incremental rate consistant with the supply of bags remaining in said magazine; said advancing means being acted upon by said sensing means during disengagement of said magazine positioning means from a fixed position to urge said depleted working magazine into an outboard position simultaneously with the introduction of a fully loaded reserve magazine into the product flow line; each of said magazines being further defined by body member means having an adjustable telescoping sections positionable in accordance with the length of bag being employed, said telescoping sections being disposed intermediate to a tail segment at one end and a lip segment at the opposite end; cam means connected to said body member for elevating and maintaining said magazine in a plane coincident with the line of travel of the product to be packaged, regardless of the total number of bags in said magazine at a given time; and tension means connected to said tail segment for maintaining the respective bag tail segments in a line consistant with said body member.

2. An apparatus as claimed in claim 1, wherein: said advancing means is defined by a cam follower assembly engageable with magazine drive means.

3. An apparatus as claimed in claim 1, wherein: each of said magazines being rotatably mounted on shaft means and positioned 180° apart, said shaft means being connected to an associated parallel linkage for movement into and out of a position outboard of said machine in response said second sensing means.

4. An apparatus as claimed in claim 1, wherein: said telescoping segments being adjustable in response to the movement of rack and pinion elements connected thereto, for causing the movement of said segments in the path of travel of said product to be bagged.

5. An apparatus as claimed in claim 3, including: shaft means for causing relative rotational movement of each of said magazines connected thereto; each of said magazines being rotated for a distance defined by the seating of an abuttment means within a predefined opening on rotation position means connected to said shaft means.

6. An apparatus as claimed in claim 1, wherein: tension applied to said tail segment serves to define a rate of upward travel in excess of that of said body segment of said working magazine.

7. A bag supply magazine as claimed in claim 1, wherein: said lip segment of said magazine being provided with an elongated wire means connected thereto, said wire means acting on said lip segment of said bag through pinching action formed to enable breakaway resistance of said bag with respect to said elongated wire to be controlled by air pressure means exerted thereat.

8. A bagging magazine apparatus as claimed in claim 1, wherein: locking means are employed on said apparatus to disengage said reserve magazine for positioning inboard of said apparatus and simultaneously permit the outboard movement of said depleted magazine.

* * * * *